United States Patent [19]

Liggett et al.

[11] 4,382,312

[45] May 10, 1983

[54] MULTIPOSITION HOOD HINGE MECHANISM

[75] Inventors: Allen C. Liggett, Royal Oak; Nicholas Toruk, West Bloomfield Township, Oakland County, both of Mich.

[73] Assignee: General Motors Corporation, Detroit, Mich.

[21] Appl. No.: 270,611

[22] Filed: Jun. 5, 1981

[51] Int. Cl.[3] ..... E05D 3/06

[52] U.S. Cl. ..... 16/365; 16/288; 16/369; 16/370; 180/69 C

[58] Field of Search ..... 16/287, 288, 302, 365, 16/366, 368, 369, 370; 296/36, 76; 180/69.2, 69.21

[56] References Cited

U.S. PATENT DOCUMENTS

| | | | |
|---|---|---|---|
| 2,698,957 | 1/1955 | Vigmostad . | |
| 2,720,676 | 10/1955 | Vigmostad . | |
| 2,956,303 | 10/1960 | Fiedler | 16/288 |
| 3,351,975 | 11/1967 | Goto . | |
| 4,012,807 | 3/1977 | Kern | 16/288 |
| 4,125,170 | 11/1978 | Botz . | |

*Primary Examiner*—Howard N. Goldberg
*Assistant Examiner*—Fred A. Silverberg
*Attorney, Agent, or Firm*—Patrick M. Griffin

[57] ABSTRACT

A hood hinge mechanism includes upper and lower brackets interconnected by pivoted links. An auxiliary hinge member is pivoted to the upper bracket and secured to the hood. The lower bracket is secured to the body. The upper hinge bracket and auxiliary hinge member are releasably secured to each other and normally move together as the hood moves between closed and partially open positions. When the auxiliary hinge member is released from the upper hinge bracket, the hood can be moved to various further open positions.

2 Claims, 3 Drawing Figures

MULTIPOSITION HOOD HINGE MECHANISM

BACKGROUND OF THE INVENTION

The prior art includes many examples of hinge mechanisms designed to mount an alligator-type hood to a vehicle compartment. Such mechanisms generally limit movement of the hood to a single open position wherein the hood blocks access to a portion of the vehicle compartment. This presents obvious problems during repair and certain assembly operations.

SUMMARY OF THE INVENTION

This invention solves the access problem of a single position hood by providing a hinge mechanism which allows for a plurality of additional open positions of the hood once it has reached its usual first open position. In the embodiment disclosed, a parallelogram-type hood hinge has a lower bracket mounted to the vehicle in the conventional manner. The upper bracket of the parallelogram-type hinge is not, however, mounted directly to the alligator-type hood, as is conventional, but is rotatably mounted to an auxiliary hinge member which is in turn mounted to the hood. The upper hinge bracket and auxiliary hinge member include alignable, matching holes therein to receive releasable fasteners which securely join them together so that they move together in conventional fashion as the alligator-type hood moves from closed to a first open position. When additional access is desired to that part of the vehicle compartment blocked by the hood, the releasable fasteners are removed and the hood may be moved to a plurality of additional open positions as the auxiliary hinge member pivots relative to the upper hinge bracket. The fasteners may be replaced when the additional access is no longer needed and the hood has been returned to the first open position.

BRIEF DESCRIPTION OF THE DRAWINGS

The operation and structure of the invention will appear from the following description and accompanying drawings in which.

DESCRIPTION OF THE PREFERRED EMBODIMENT

Figure 1:
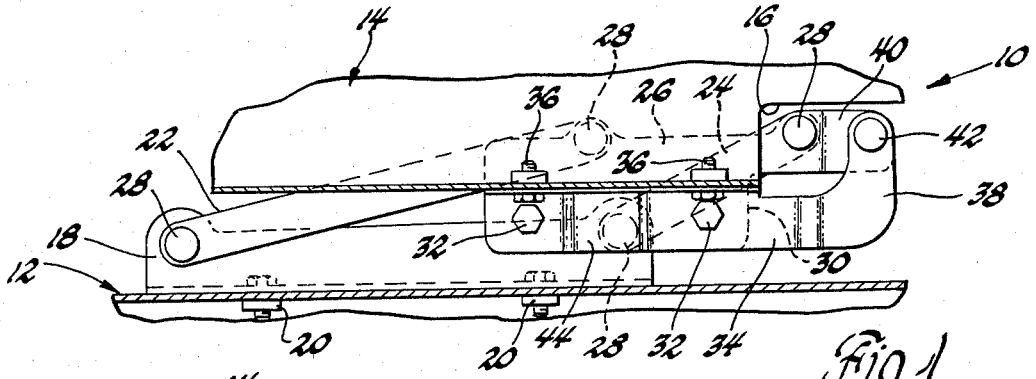
FIG. 1 is a partial side view of a vehicle having an alligator-type hood mounted thereon by a hinge mechanism according to the invention, with the hood shown in the closed position.
Figure 2:
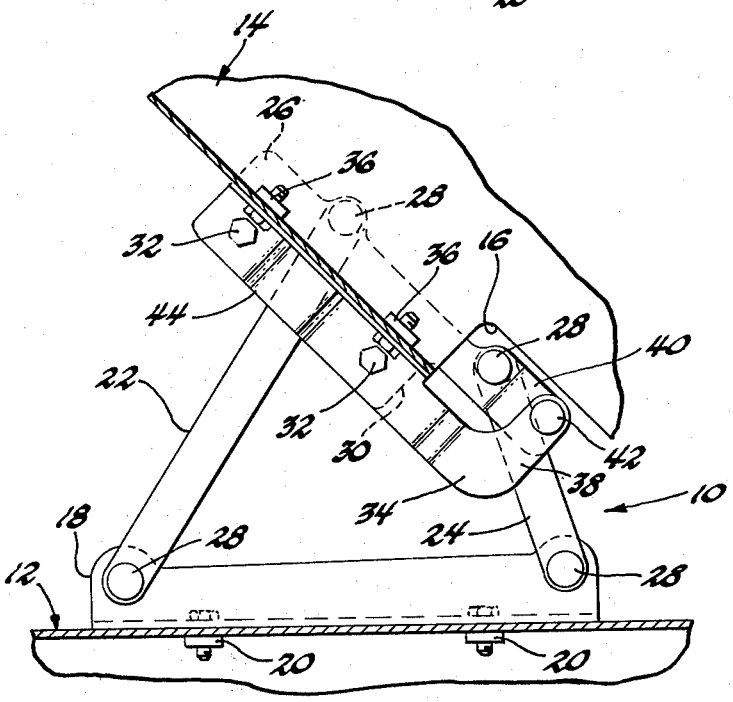
FIG. 2 is a view similar to FIG. 1 showing the hinge mechanism and hood in a first open position.
Figure 3:
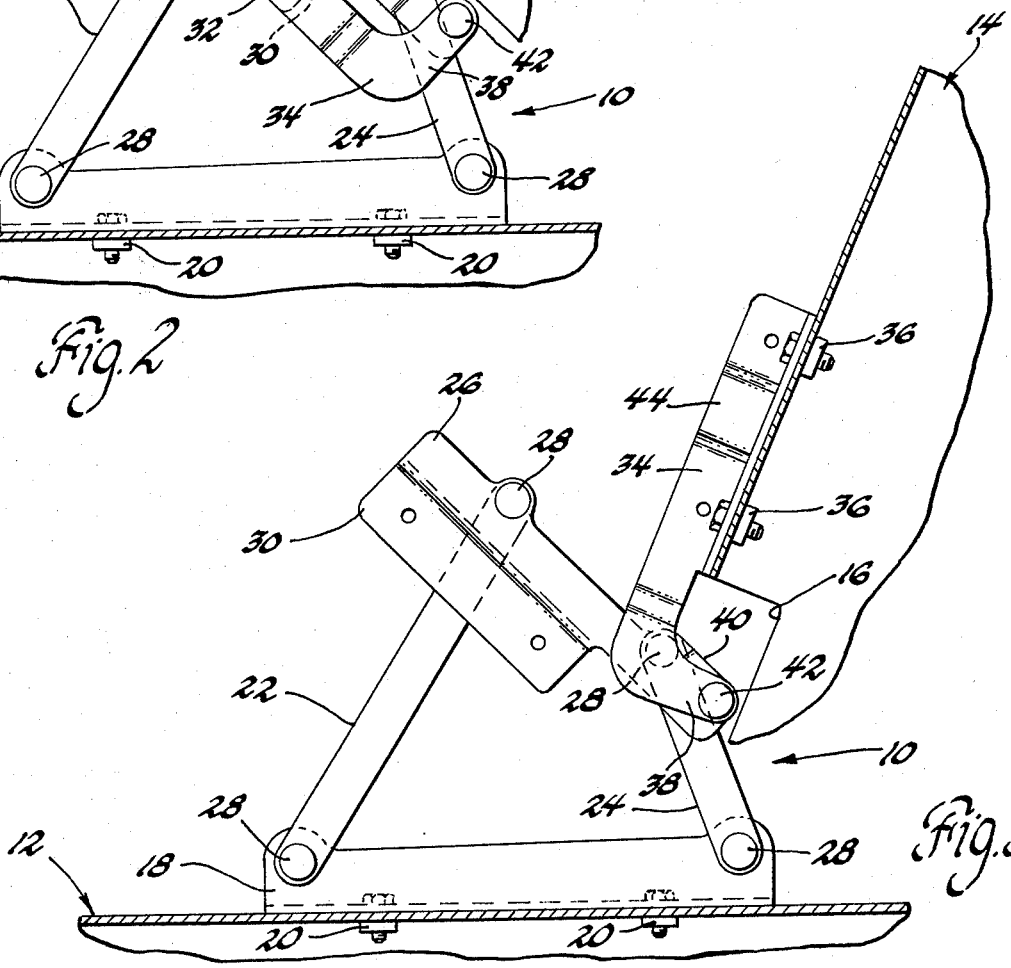
FIG. 3 is a view similar to FIG. 2 showing the hood and hinge mechanism in one of a plurality of additional open positions.

Referring to FIGS. 1–3, the hinge mechanism of the invention designated generally 10 is shown mounted to the vehicle hood compartment designated generally at 12. An alligator-type vehicle hood designated generally at 14 is mounted to hood compartment 12 by hinge mechanism 10. Hinge mechanism 10 would be mounted proximate the base of the windshield, not shown. Vehicle hood 14 is relieved at 16.

A lower hinge bracket 18 is conventionally secured by bolts 20 through a lateral flange thereof to a side wall of hood compartment 12. A pair of parallelogram-type links 22 and 24 pivotally attach lower hinge bracket 18 to an upper hinge bracket 26. This pivotal attachment is accomplished through conventional shouldered pivots

28 at four points. Thus, upper and lower hinge brackets 18 and 26 along with links 22 and 24 comprise a parallelogram-type hinge mechanism. Upper hinge bracket 26 includes along the bottom thereof an offset flange 30, as best seen in FIG. 3, which is securely but releasably attached by means of bolts 32 to a third or auxiliary hinge member 34. A lateral flange of auxiliary hinge member 34 is in turn securely attached by bolts 36 to vehicle hood 14. When auxiliary hinge member 34 and upper hinge bracket 26 are securely attached together by bolts 32, it is apparent that they will move as a unit as hood 14 moves from the FIG. 1 closed position to the FIG. 2 first open position and links 22 and 24 swing counterclockwise about their pivots 28 to hinge bracket 18. Completing the construction of the invention, the ends 38 and 40 of auxiliary hinge member 34 and upper hinge bracket 26 respectively are offset slightly outwardly from the plane of the drawing and pivoted together by shouldered pivot 42. In addition, auxiliary hinge member 34 has an integral stamped rib 44 therein offset outwardly from the plane of the drawing.

Referring to FIG. 2 which shows hood 14 in the first open position, it is apparent that vehicle compartment 12 is partially blocked by hood 14. To create additional access, bolts 32 are removed allowing auxiliary hinge member 34 to rotate about pivot 42 and thus allowing hood 14 to move to a plurality of further open positions, creating additional access, as shown in FIG. 3. The offset ends 40 and 38 assure that the pivot 28 on link 24 will not bind with an auxiliary hinge member 34 and the offset rib 44 assures clearance of pivot 28 on link 22. While it is necessary that hood 14 be moved to the first open position of FIG. 2 before bolts 32 can be removed, hood 14 will remain in that position after the bolts are removed as the hinge mechanism 10 is located at the lowest end of the hood 14, which will simply rest against upper hinge bracket 26 under its own weight. Any conventional hold open mechanism may be incorporated into the hinge mechanism.

Thus the invention provides an improved hood hinge for mounting an alligator-type hood to a vehicle in which the vehicle hood may be moved to a plurality of additional open positions to give improved access.

The embodiments of the invention in which an exclusive property or privilege is claimed are defined as follows:

1. A multiposition hinge mechanism for mounting an alligator-type hood to a vehicle for movement between closed and multiple open positions with respect to a vehicle compartment, comprising, a lower vehicle mounted hinge member, an upper hinge member, means interconnecting the lower and upper members for relative movement between a closed position and a first open position, a third hinge member, means pivotably mounting the third hinge member to the upper hinge member for movement relative thereto, means mounting the third hinge member to the vehicle hood, releasable means directly securing the third hinge member to the upper hinge member for concurrent movement of the upper hinge member, third hinge member, and hood as a unit relative to the lower hinge member and compartment between a closed position and a first open position wherein the hood partially blocks the vehicle compartment, removal of the releasable securing means allowing the third hinge member and hood to move relative to the upper hinge member to a plurality of additional open positions with respect to the vehicle to obtain full access to the vehicle compartment.

2. A multiposition hinge mechanism for mounting an alligator-type hood to a vehicle for movement of the hood between closed and multiple open positions with respect to a vehicle compartment, comprising, a lower vehicle mounted hinge member, an upper elongated hinge member, means interconnecting the lower and upper members for relative movement between a closed position and a first open position, a third elongated hinge member generally laterally aligned to the upper hinge member, means pivotally mounting respective ends of the third hinge member and the upper hinge member to each other, removable fastener means extending through alignable lateral openings in the upper hinge member and third hinge member to secure such hinge members to each other for concurrent movement relative to the lower hinge member, means mounting the third hinge member to the vehicle hood, the upper hinge member, the third hinge member and the hood being movable as a unit relative to the lower hinge member to move the hood from a closed position to a first open position relative to the vehicle compartment wherein the hood partially blocks the vehicle compartment, removal of the removable fastener means allowing the third hinge member and hood to pivot as a unit relative to the upper hinge member to a plurality of additional open positions with respect to the vehicle compartment to obtain full access thereto.

* * * * *